US006293701B1

(12) United States Patent
Tomic

(10) Patent No.: US 6,293,701 B1
(45) Date of Patent: Sep. 25, 2001

(54) RESEALABLE CLOSURE MECHANISM HAVING SLIDER DEVICE AND METHODS

(76) Inventor: Mladomir Tomic, 4624 W. Grand Meadows Dr., Appleton, WI (US) 54915

( * ) Notice: Subject to any disclaimer, the term of this patent is extended or adjusted under 35 U.S.C. 154(b) by 0 days.

(21) Appl. No.: 09/365,215

(22) Filed: Jul. 30, 1999

Related U.S. Application Data

(60) Provisional application No. 60/108,845, filed on Nov. 18, 1998.

(51) Int. Cl.[7] ..... B65D 33/16

(52) U.S. Cl. ..... 383/64; 24/427; 24/400

(58) Field of Search ..... 383/64, 63, 65; 24/427, 399, 400

(56) References Cited

U.S. PATENT DOCUMENTS

| | | | | |
|---|---|---|---|---|
| D. 325,547 | | 4/1992 | Saito et al. . | |
| D. 380,988 | | 7/1997 | Mizuno . | |
| 3,115,689 | * | 12/1963 | Jacobs | 24/427 |
| 3,122,807 | * | 3/1964 | Ausnit | 383/64 X |
| 3,173,184 | * | 3/1965 | Ausnit | 383/64 X |
| 3,324,520 | * | 6/1967 | Ausnit | 383/64 X |
| 3,633,642 | * | 1/1972 | Siegel | 383/64 |
| 3,713,923 | | 1/1973 | Laguerre . | |
| 4,262,395 | | 4/1981 | Kosky . | |
| 4,335,817 | | 6/1982 | Bahr . | |
| 4,337,889 | | 7/1982 | Moertel . | |
| 4,561,108 | | 12/1985 | Kamp . | |
| 4,620,320 | | 10/1986 | Sullivan . | |
| 4,710,968 | | 12/1987 | Borchardt et al. . | |
| 4,883,329 | | 11/1989 | Flannery et al. . | |
| 4,890,935 | | 1/1990 | Ausnit et al. . | |
| 4,944,072 | | 7/1990 | Robson . | |
| 5,007,142 | | 4/1991 | Herrington . | |
| 5,007,143 | | 4/1991 | Herrington . | |
| 5,010,627 | | 4/1991 | Herrington et al. . | |
| 5,020,194 | | 6/1991 | Herrington et al. . | |
| 5,063,644 | | 11/1991 | Herrington et al. . | |
| 5,067,208 | | 11/1991 | Herrington, Jr. et al. . | |
| 5,070,583 | | 12/1991 | Herrington . | |
| 5,088,971 | | 2/1992 | Herrington . | |
| 5,131,121 | | 7/1992 | Herrington, Jr. et al. . | |
| 5,140,796 | | 8/1992 | Pope . | |
| 5,161,286 | | 11/1992 | Herrington, Jr. et al. . | |
| 5,167,608 | | 12/1992 | Steffens, Jr. et al. . | |
| 5,189,764 | | 3/1993 | Herrington et al. . | |
| 5,211,482 | | 5/1993 | Tilman . | |
| 5,283,932 | | 2/1994 | Richardson et al. . | |
| 5,301,394 | | 4/1994 | Richardson et al. . | |

(List continued on next page.)

FOREIGN PATENT DOCUMENTS

| | | |
|---|---|---|
| 1 299 797 | 6/1962 | (FR) . |
| 2 617 022 | 12/1988 | (FR) . |
| WO 99/62780 | 12/1999 | (WO) . |
| WO 99/62781 | 12/1999 | (WO) . |
| WO 99/65353 | 12/1999 | (WO) . |

*Primary Examiner*—Jes F. Pascua

(57) ABSTRACT

A slider device for use with a resealable package includes a top wall with first and second ends, a spreader depending from the top wall, a first sidewall, a second sidewall, a first hook construction extending from the first sidewall, a second hook construction extending from the second sidewall, and a guide construction. Preferably, the slider device includes a pair of drag-reducing standoffs in projection from the sidewalls. In preferred embodiments, the guide construction includes first and second fingers projecting beyond at least one end of one of the sidewalls. The slider device is usable with a reclosable zipper arrangement defining a pair of shoulders for engaging with the hook constructions of the slider device. Certain embodiments may include ridge structure on the slider and zipper for providing tactile feedback to the user. In another embodiment, there may be a color change as the zipper changes condition from an open position to a closed, interlocked position. Methods of assembling and operation are described.

29 Claims, 12 Drawing Sheets

U.S. PATENT DOCUMENTS

| | | |
|---|---|---|
| 5,301,395 | 4/1994 | Richardson et al. . |
| 5,405,478 | 4/1995 | Richardson et al. . |
| 5,426,830 | 6/1995 | Richardson et al. . |
| 5,431,760 | 7/1995 | Donovan . |
| 5,442,837 | 8/1995 | Morgan . |
| 5,442,838 | 8/1995 | Richardson et al. . |
| 5,448,807 | 9/1995 | Herrington, Jr. . |
| 5,448,808 | 9/1995 | Gross . |
| 5,482,375 | 1/1996 | Richardson et al. . |
| 5,577,305 | 11/1996 | Johnson . |
| 5,636,415 | 6/1997 | James . |
| 5,636,783 | 6/1997 | Preston . |
| 5,638,586 | 6/1997 | Malin et al. . |
| 5,664,299 | 9/1997 | Porchia et al. . |
| 5,669,715 | 9/1997 | Dobreski et al. . |
| 5,681,115 | 10/1997 | Diederich et al. . |
| 5,682,730 | 11/1997 | Dobreski . |
| 5,689,866 | 11/1997 | Kasai et al. . |
| 5,713,669 | 2/1998 | Thomas et al. . |
| 5,722,128 | 3/1998 | Toney et al. . |
| 5,769,772 | 6/1998 | Wiley . |
| 5,775,812 | 7/1998 | St. Phillips et al. . |
| 5,788,378 | 8/1998 | Thomas . |
| 5,833,791 | 11/1998 | Bryniarski et al. . |
| 5,851,070 | 12/1998 | Dobreski et al. . |
| 5,867,875 | 2/1999 | Beck et al. . |
| 5,871,281 | 2/1999 | Stolmeier et al. . |
| 5,896,627 | 4/1999 | Cappel et al. . |
| 5,911,508 | 6/1999 | Dobreski et al. . |
| 5,924,173 | 7/1999 | Dobreski et al. . |
| 5,938,337 | 8/1999 | Provan et al. . |
| 5,956,924 | 9/1999 | Thieman . |
| 5,964,532 | 10/1999 | St. Phillips et al. . |
| 6,010,244 | 1/2000 | Dobreski et al. . |
| 6,014,795 | 1/2000 | McMahon et al. . |

* cited by examiner

RESEALABLE CLOSURE MECHANISM HAVING SLIDER DEVICE AND METHODS

CLAIM TO PRIORITY UNDER 35 U.S.C. §119(e)

Priority under 35 U.S.C. §119(e) is claimed to provisional application Ser. No. 60/108,845, filed on Nov. 18, 1998, and entitled, "Resealable Closure Mechanism Having a Slider Device and Methods." The complete disclosure of application Ser. No. 60/108,845 is incorporated by reference herein.

FIELD OF THE INVENTION

The present invention generally relates to closure arrangements for polymer packages, such as, plastic bags. In particular, the present invention relates to resealable closure mechanisms or zipper-type closures for resealable packages.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. The internal sidewalls of the slider device are configured so that the sidewalls engage the closure profiles and progressively move them into engagement to close the resealable package when the slider device is moved along the closure mechanism in a direction opposite the first direction.

Improvements in the design and manufacture of closure mechanisms and slider devices are desirable.

SUMMARY OF THE DISCLOSURE

In one aspect a slider device is disclosed for use with a resealable closure mechanism having a first closure profile and a second closure profile. One preferred slider device includes a top wall; a spreader depending from the top wall; first and second sidewalls; first and second hook constructions; and a guide construction projecting beyond at least one of a first end and a second end of the first sidewall.

In some embodiments, the guide construction includes first and second fingers, with at least one of: (a) the first finger projecting beyond the first end; and (b) the second finger projecting beyond the second end. In some embodiments, both: (a) the first finger projects beyond the first end of the first sidewall; and (b) the second finger projects beyond the second end of the first sidewall. In other embodiments, only one of the fingers projects beyond a respective end of the first sidewall.

Preferably, the slider device further includes first and second standoffs in projection from the first and second sidewalls, respectively.

The disclosure also concerns a reclosable zipper arrangement. In one embodiment described, the zipper arrangement includes a first closure profile defining a first shoulder and a second closure profile defining a second shoulder. A slider device is provided with a spreader to separate the first and second closure profiles. First and second hook constructions on the slider device slidably engage with the first and second shoulders of the first and second closure profiles, respectively. A guide construction preferably projects beyond at least one of a first and second end of a sidewall of the slider device.

Flexible packages are provided that comprise a package surrounding wall having first and second side seals and a mouth therebetween. A reclosable zipper is provided along the mouth for selective opening and closing of the mouth. A slider device of the type characterized above is operably mounted on the package. One preferred zipper includes first and second closure profiles defining first and second shoulders, respectively. First and second hook constructions on the slider device are included for sliding along the first and second shoulders, respectively. A guide construction is provided on the slider device.

Methods of using a resealable package are described. Methods include a step of moving a slider device along a mouth a first direction from a side seal of the resealable package until a projecting finger on the slider device engages a first side seal on the resealable package. Packages and slider devices as described herein may be usable in this method.

DETAILED DESCRIPTION

Figure 1:
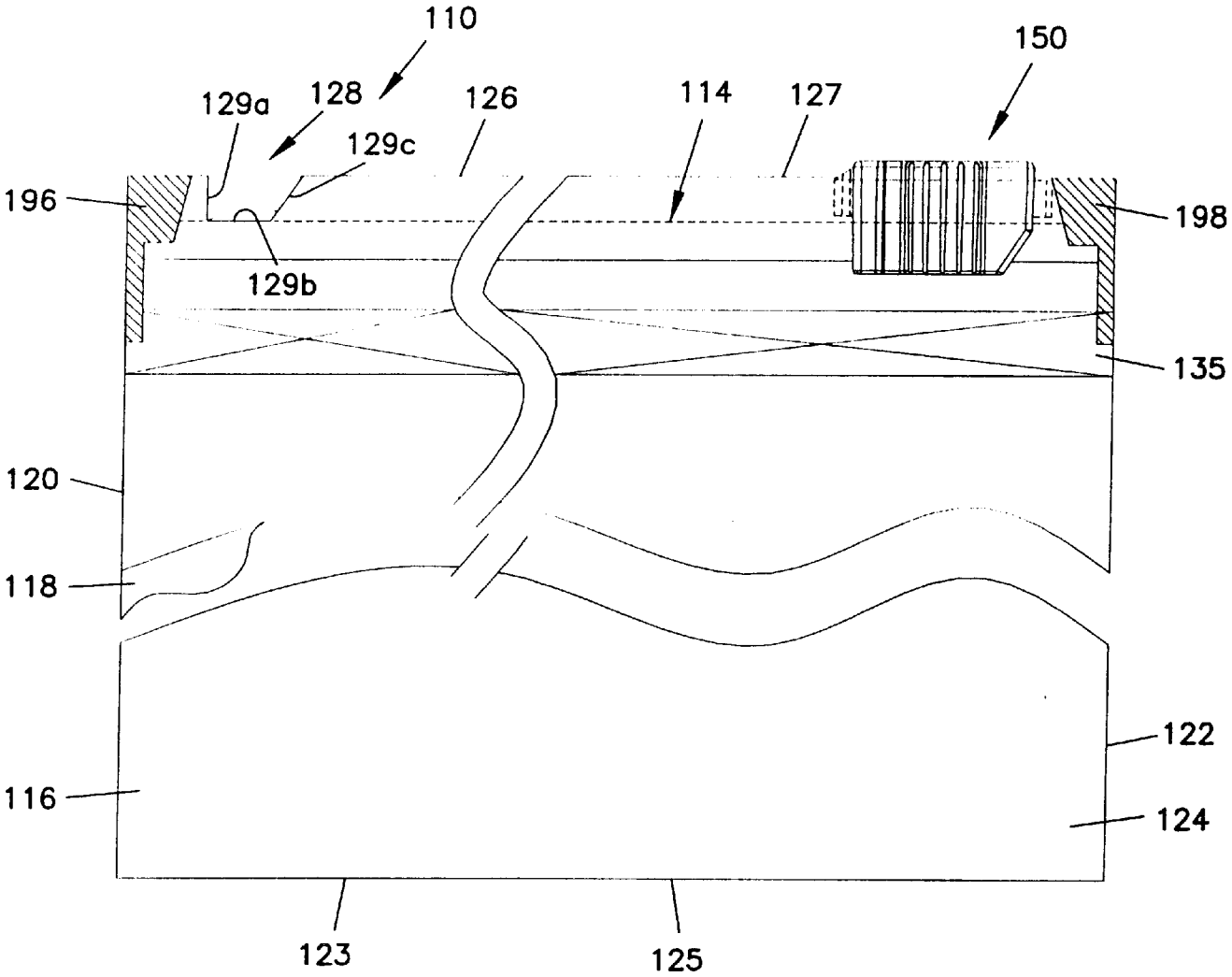
FIG. 1 is a side elevational, schematic view of a first embodiment of a flexible, resealable package having a slider device, according to principles of this disclosure.

Attention is directed to FIG. 1. FIG. 1 illustrates an example packaging arrangement in the form of a resealable, flexible package 110, for example, a polymeric package such as a plastic bag, having a resealable closure mechanism 114, for example, interlocking profiled elements, constructed in accordance with the present invention. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110. The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles. Preferably, the zipper-type closure mechanism is not a rolling action type zipper. That is, preferably the closure is not one that closes by movement from a 6 o'clock position to a 12 o'clock position. It is noted, however, that slider devices 150 of the types described herein are usable with rolling action type zippers. Preferred zipper-type closure mechanisms described herein close by movement from a 9 o'clock to a 3 o'clock position.

Figure 2:
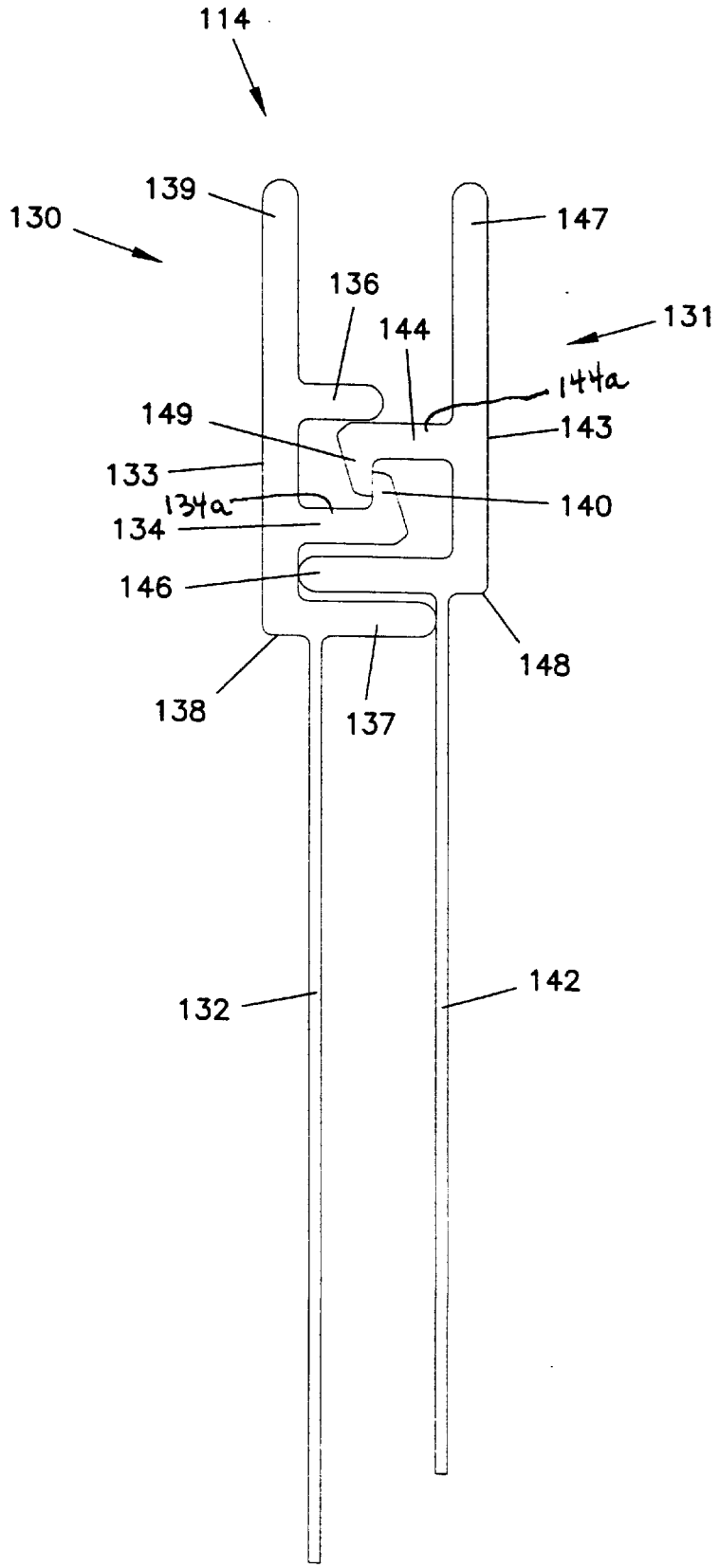
FIG. 2 is a cross-sectional view of a first embodiment of profiled elements usable with the resealable package of FIG. 1, according to principles of this disclosure.

In particular, the zipper-type closure mechanism in FIG. 2 is an illustration of one example of a closure mechanism 114. The closure mechanism 114 includes an elongated first closure profile 130 and an elongated second closure profile 131. Typically, the closure profiles 130, 131 are manufactured separately from each other.

Still in reference to FIG. 2, the preferred first closure profile 130 depicted includes a sealing flange or bonding strip 132, a base strip 133, a first closure member 134, first and second guide posts 136, 137, and an upper flange 139. The closure member 134 extends from the base strip 133 by way of a stem 134*a* and is generally projecting from the base strip 133. At a free end of the stem 134*a* (the tip of the closure member 134) is a hook or catch 140. The guide posts 136, 137 also extend from the base strip 133 and are generally projecting from the base strip 133. The guide posts 136, 137 aid in holding the closure mechanism 114 closed and in aligning the first closure profile 130 with the second closure profile 131 for interlocking. The bonding strip 132 depends or extends downward from the second guide post 137 and can be attached to a first panel section, such as the first panel section 116 of the package 110 of FIG. 1 at region 135 (FIG. 1). A first shoulder 138 is defined by the intersection of the base strip 133 and bonding strip 132. In the example illustrated, the bonding strip 132 is spaced a distance laterally from the base strip 133 to define a corner forming the shoulder 138. The upper flange 139 extends upwardly from the base strip 133 and first guide post 136.

The preferred second closure profile 131 depicted includes a bonding strip 142, a base strip 143, a first closure member 144, a guide post 146, and an upper flange 147. The closure member 144 extends from the base strip 143 by way of a stem 144*a* and is generally projecting from the base strip 143. At a free end of the stem 144*a* (or tip of the closure member 144) is a hook or catch 149. The guide post 146 also extends from the base strip 143 and is generally projecting from the base strip 143. The guide post 146 aids in holding the closure mechanism 114 closed and aids in aligning the second closure profile 131 with the first closure profile 130 for interlocking. The bonding strip 142 depends or extends downward from the guide post 146 and can be attached to a second panel section, such as the second panel section 118 of the package 110 of FIG. 1. A shoulder 148, analogous to the shoulder 138, is formed at the corner of the bonding strip 142 and guide post 146.

The first and second closure profiles 130, 131 are designed to engage with one another to form the resealable closure mechanism 114. The closure member 134 of the first closure profile 130 extends from the base strip 133 a first distance. The closure member 144 of the second closure profile 131 also extends from the base strip 143 a first distance. These first distances that the closure members 134, 144 extend are sufficient to allow mechanical engagement, or interlocking, between the first closure member 134 of the first closure profile 130 and the first closure member 144 of the second closure profile 131. In particular, the catches 140, 149 hook or engage each other. Furthermore, the closure profiles 130, 131 are sealed together at their ends, such as regions 196, 198 of FIG. 1, to further aid in aligning the closure profiles 130, 131 for interlocking through processes such as ultrasonic crushing. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126 (FIG. 1).

In some applications, the closure profiles 130, 131 are formed by two separate extrusions or through two separate openings of a common extrusion. Typically, the resealable closure mechanism 114 is made of conventional materials, such as a polymeric, plastic material, for example, polyethylene or polypropylene. In one example embodiment, the closure arrangement illustrated in FIG. 2 is manufactured using conventional extrusion and heat sealing techniques.

Attention is again directed to FIG. 1. In FIG. 1, note that there is a cutout or notch 128 formed in the upper flanges 139, 147 (FIG. 2) of the resealable closure mechanism 114. The preferred notch 128 shown includes two straight edges or sides 129*a*, 129*b*, generally perpendicular to each other, and a side 129*c* that extends at, in a preferred embodiment, an oblique angle relative to side 129*b*. By "oblique angle", it is meant an angle that is not substantially perpendicular or straight. The side 129*a* preferably is generally parallel to side edge 120, while the side 129*b* preferably is generally parallel to the bottom edge 125. The side 129*c* can extend at an angle relative to side 129*b* of at least 30 degrees, typically between about 100–150 degrees, typically no greater than about 160 degrees, and in the preferred embodiment about 135 degrees. As to be explained in further detail below, the notch 128 serves as a "parking place" for a slider device 150 and also facilitates mounting the slider device 150 onto the resealable package 110 during initial assembly. In addition, the edge 129*a* closest to the side seal 120 helps to create a stop member for the slider device 150. Further, the angle that the side 129*c* extends helps to reduce friction between the slider device 150 and the resealable closure mechanism 114, when the slider device 150 is being moved from the notch 128 to open the closure mechanism 114. This contributes to an easier opening, more convenient package 110.

Figure 3:
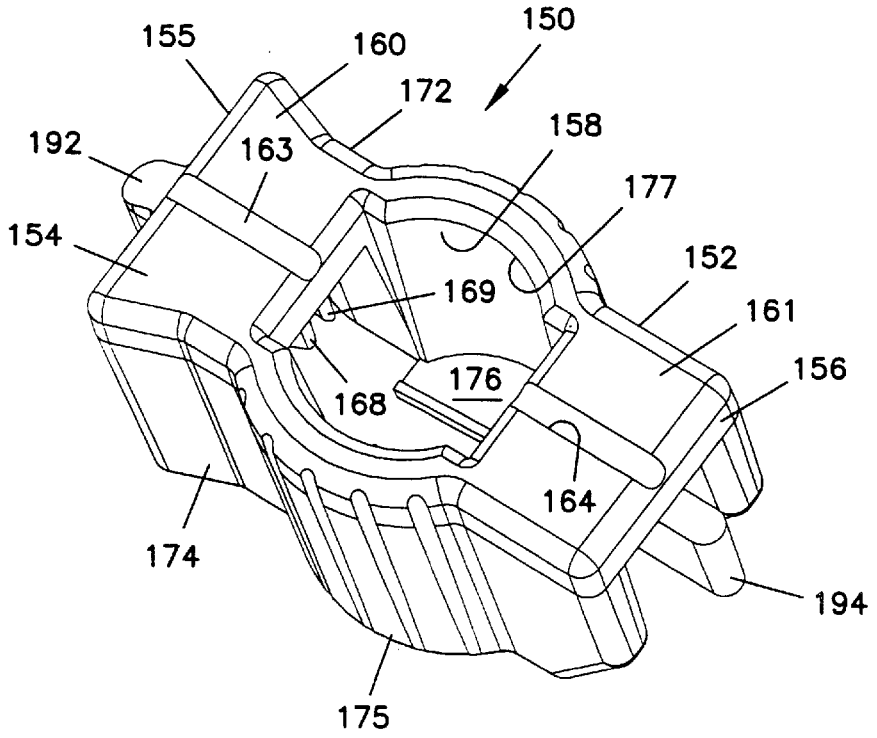
FIG. 3 is an enlarged, top perspective view of the slider device of FIG. 1.
Figure 4:
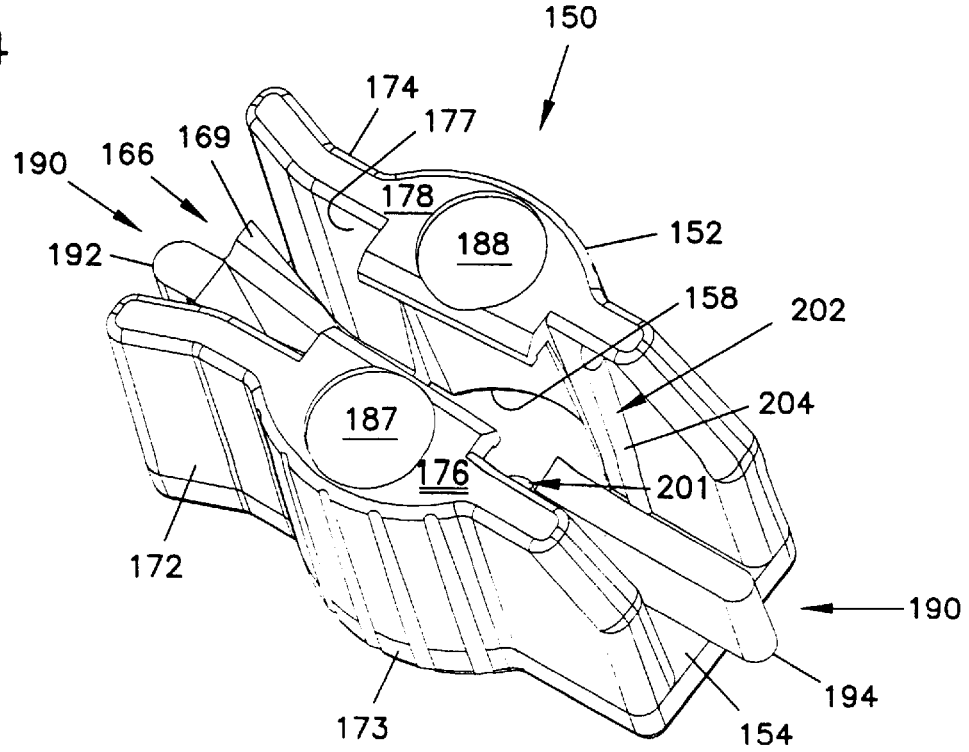
FIG. 4 is an enlarged, bottom perspective view of the slider device of FIGS. 1 and 3.

Still referring to FIG. 1, the slider device 150 is provided to open and close the resealable closure mechanism 114. Attention is directed to FIGS. 3 and 4. One preferred slider device 150 is illustrated in FIGS. 3 and 4 in perspective view and preferably comprises a one-piece unitary, molded plastic member with no moveable parts that are moveable with respect to one another. In general, the slider device 150 includes a housing 152 for slidably engaging the closure mechanism 114. The housing 152 is movable between a closed position of the resealable package 110 when the housing 152 is adjacent the side edge 120 and an open position of the resealable package 110 when the housing 152 is adjacent the side edge 122. FIG. 1 illustrates the resealable package 110 in an open position. The housing 152 slides over the resealable closure mechanism 114 relative to the top edge 127 of the resealable package 110 to open and close the mouth 126.

The housing 152 is preferably a multi-sided container configured for engaging or locking onto or over the resealable closure mechanism 114. In the particular embodiment illustrated in FIGS. 3 and 4, the housing 152 includes a top wall 154. By the term "top", it is meant that in the orientation of the slider device 150 shown in FIG. 1, the wall 154 is oriented above the remaining portions of the housing 152. It should be understood, of course, that if the housing 152 is moved from the orientation shown in FIG. 1, the top wall 154 will not be in a top orientation. The top wall 154 defines a first end 155 and an opposite second end 156. The top wall 154 also defines an open aperture 158. The open aperture 158 divides the top wall 154 between a first portion 160 and a second portion 161. The first portion 160 generally comprises a flat, planar portion in extension from a periphery of the open aperture 158 to the edge defined by the first end 155. Similarly, the second portion 161 generally comprises a flat, planar portion in extension from a periphery of the open aperture 158 to the edge defined by the second end 156. Each of the first and second portions 160, 161 defines a groove 163, 164 respectively. The aperture 158 and grooves 163, 164 in some systems, aid in providing a structure that may be more easily injection molded.

The housing 152 includes a separation structure for separating the first and second closure profiles 130, 131. That is, when the resealable closure mechanism 114 is in a closed state such that the closure members 134, 144 are interlocked, the separation structure will apply a force to wedge open and pull the closure members 134, 144 apart from each other. In the embodiment illustrated, the housing 152 includes a spreader 166 operating as a separation structure. The spreader 166, in the preferred embodiment shown, extends or depends from the top wall 154. Preferably, the spreader 166 comprises first and second angled wedges 168, 169 separated by a gap 170 (FIG. 5) therebetween.

Figure 5:
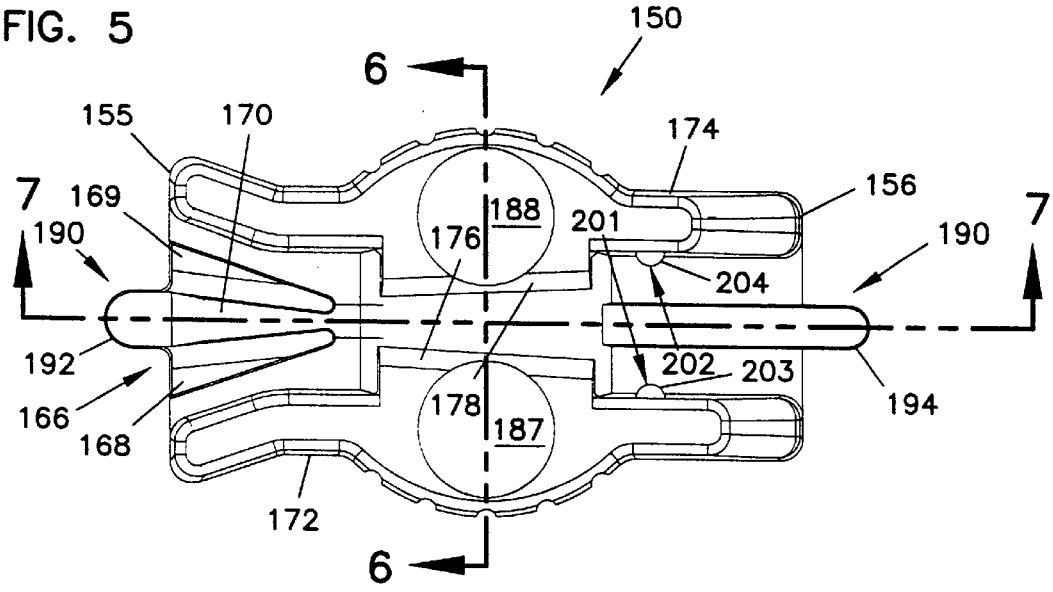
FIG. 5 is a bottom plan view of the slider device depicted in FIGS. 3 and 4.

Attention is directed to FIG. 5. In FIG. 5, it can be seen that the first and second wedges 168, 169 are angled toward each other, from the first end 155 of the slider device 150 to an opposite end of the wedges 168, 169, to form an overall triangle shaped spreader 166, in plan view, with an apex of the triangle pointing toward the second end 156 of the housing 152. In some system, the gap 170 between the first wedge 168 and second wedge 169 helps to contribute to convenient manufacturing techniques for the housing 152, such as injection molding. Preferably, the spreader 166 only extends partially in the resealable closure mechanism 114. More preferably, the spreader 166 only extends between the open flanges 139, 147 and does not penetrate the closure members 134, 144. This helps to reduce likelihood of leaks in the closure mechanism 114. In the preferred embodiment shown, the spreader 166 preferably extends about 0.125 inches from the first portion 160 of the top wall 154.

In reference again to FIGS. 3 and 4, the preferred housing 152 shown also includes first and second sidewalls 172, 174. Preferably, each of the first and second sidewalls 172, 174 extends from and is cantilevered from the top wall 154 to form a slide channel 177 therebetween. In preferred embodiments, the first and second sidewalls 172, 174 are injection molded with the remaining parts of the housing 152. In other words, preferably the housing 152 comprises a single, unitary, integral piece of material with no additional materials welded, fastened, or bolted together. As can be viewed in FIGS. 3 and 4, the sidewalls 172, 174 can include texturization, such as ribs, 173, 175 to help improve gripping and handling by the user. In FIG. 5, note that the sidewalls 172, 174 diverge away from each other at the first end 155 in the first portion 160; form convex portions in a middle section; and are generally parallel in the second portion 161. These features also facilitate gripping and handling by the user.

Preferably, the housing 152 includes a system for permitting the housing 152 to slide along the resealable closure mechanism 114 without becoming disengaged from the resealable package 110. In the embodiment illustrated, the system of the slider housing 152 engages or interlocks with certain structure of the resealable closure mechanism 114. In particular, the housing 152 has a first and a second hook construction 176, 178. The first hook construction 176 preferably extends from the first sidewall 172 in a portion of the housing 152 that is under the open aperture 158.

Figure 6:
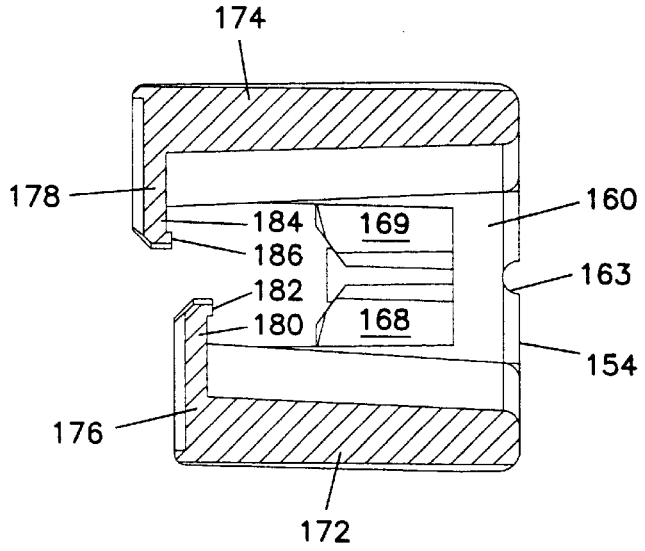
FIG. 6 is a cross-sectional view of the slider device depicted in FIG. 5 taken along the line 6—6 of FIG. 5.
Figure 13:
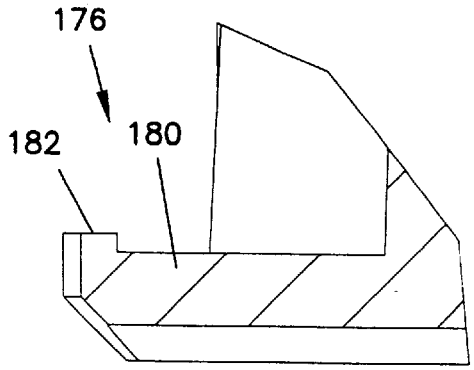
FIG. 13 is an enlarged, fragmented cross-sectional view of one of the hook constructions shown in FIG. 6.

In reference now to FIG. 6 and 13, the first hook construction 176 preferably includes a flange 180 in lateral extension from the first sidewall 172. Extending or projecting from flange 180 is a tip 182 oriented toward the top wall 154. As such, the tip 182, in combination with the flange 180, forms a hook or catch for slidable engagement with the shoulder 148 of the second closure profile 131.

Analogously, the second hook construction 178 preferably includes a flange 184 in extension from the second sidewall 174 and in a region of the housing 152 below the open aperture 158. A tip 186 projects or extends from flange 184 in a direction oriented toward the top wall 154. As such, the flange 184 and tip 186 cooperate to form a hook or catch for engaging in a slidable manner with the shoulder 138 of the first closure profile 130. As can be seen in FIG. 6, the first hook construction 176 is located closer to the top wall 154 than the second hook construction 178. This is generally because, in the embodiment shown, the second sidewall 174 is longer than the first sidewall 172.

Figure 14:
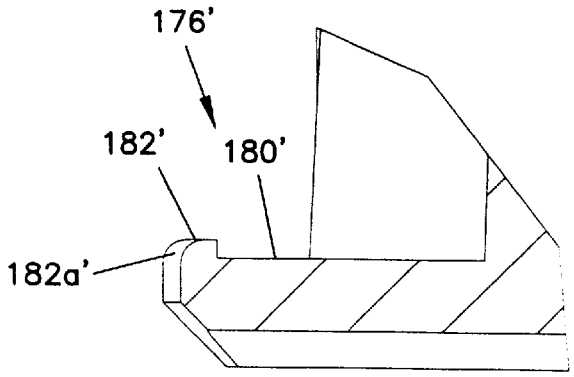
FIG. 14 is an enlarged, fragmented cross-sectional view of an alternate embodiment of the hook construction shown in FIG. 13.
Figure 15:
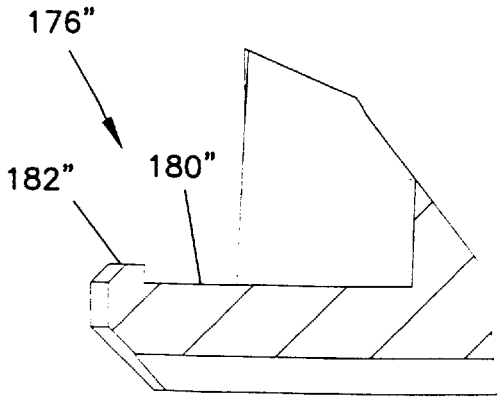
FIG. 15 is an enlarged, fragmented cross-sectional view of another alternate embodiment of the hook construction shown in FIG. 13.

Attention is directed to FIGS. 14 and 15. FIGS. 14 and 15 depict alternate embodiments for hook constructions 176, 178 at 176' and 176'. In FIG. 14, the tip 182' has a smooth, rounded corner 182*a*. In FIG. 15, the tip 182" has a bevel or chamfered corner 182*a*". It has been found that in certain applications, the alternate tips 182', 182" reduce friction and drag of the slider device 150 across the closure mechanism 114.

Attention is again directed to FIGS. 4 and 5. The first and second hook constructions 176, 178 each has circular, partial cavities 187, 188, respectively, formed therein. These cavities 187, 188 help facilitate convenient manufacturing techniques, such as injection molding.

The slider device 150 preferably includes a system for guiding the slider device 150 between the side edges 120, 122 (FIG. 1) and for preventing the slider device 150 from sliding off the edge of the package 110 (FIG. 1). In the embodiment illustrated, the system includes a guide construction 190 (FIG. 4). The guide construction 190 shown is designed to project beyond the first and second ends 155, 156 of the top wall 154. This ensures that the guide constriction 190 detects the regions of ultrasonic crushing 196, 198 before any other structure on the housing 152 engages the sides 120, 122 of the package 110. Preferably, the guide construction 190 depends from the top wall 154, but could depend from other portions of the housing 152 in other embodiments.

While a variety of structures are contemplated, in the particular embodiment illustrated in the drawings, the guide construction 190 comprises first and second bumpers or elongate fingers 192, 194. The first bumper or finger 192 preferably is molded as part of the housing 152 to extend a distance of at least about 0.06 inches (1.5 mm) beyond the first end 155 of the first portion 160. The second bumper or finger 194 likewise is preferably molded as part of the housing 152 to extend a distance of at least 0.06 inches (1.5 mm) beyond the second end 156 of the second portion 161.

In operation, the first finger 192 will abut or engage the edge 129*a* and region 196 to inhibit the housing 152 from sliding off of the resealable package 110. Analogously, the second finger 194 will abut or engage the region 198 to inhibit the housing 152 from sliding off of the resealable package 110. Thus, the guide construction 190 helps to keep the housing 152 within the boundaries or periphery defined by the side edges 120 and 122. Further detail regarding this is explained in conjunction with FIGS. 8 and 9.

Figure 8:
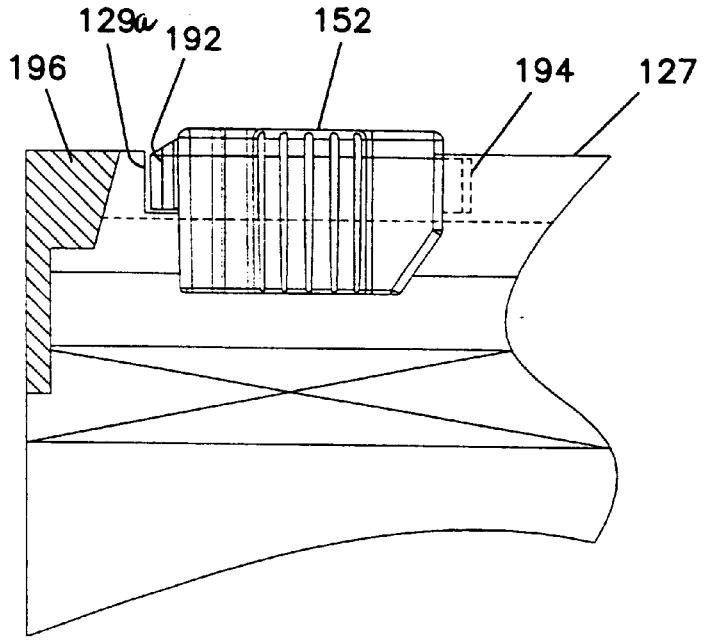
FIG. 8 is an enlarged, side elevational, fragmented, schematic view of the slider device depicted in FIGS. 1, and 3–7 oriented in a closed position of the resealable package of FIG. 1.
Figure 9:
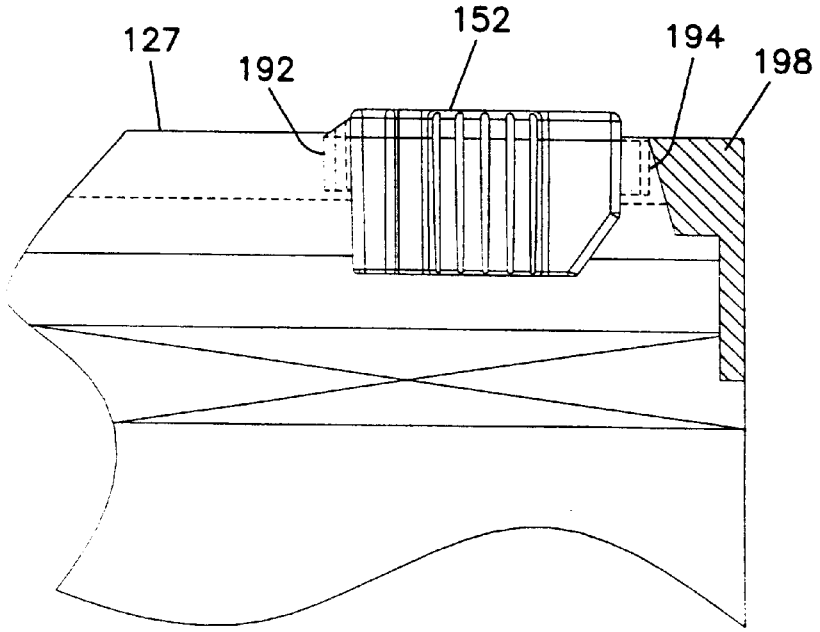
FIG. 9 is an enlarged, side elevational, fragmented, schematic view of the slider device of FIGS. 1 and 3–7 and shown in an open position of the resealable package of FIG. 1.

In FIG. 8, the slider housing 152 is shown in a position where the resealable closure mechanism 114 is closed. The first finger 192 is shown engaged with the side edge 129*a* of the notch 128. In usual operation, the first finger 192 will stop when it engages the side edge 129*a* of the notch 128. In some circumstances, however, the first finger 192 may abut and engage the region 196 of ultrasonic crushing, depending on the configuration of the region 196 and the force used by the operator of the slider 150. In FIG. 9, the housing 152 is shown in a position where the reclosable closure mechanism 114 is in an open position. The second finger 194 of the guide construction 190 (FIG. 5) is illustrated as abutting the region 198 of ultrasonic crushing. Note that the abutment or engagement occurs either below the top edge 127 or even with the top edge 127.

Figure 7:
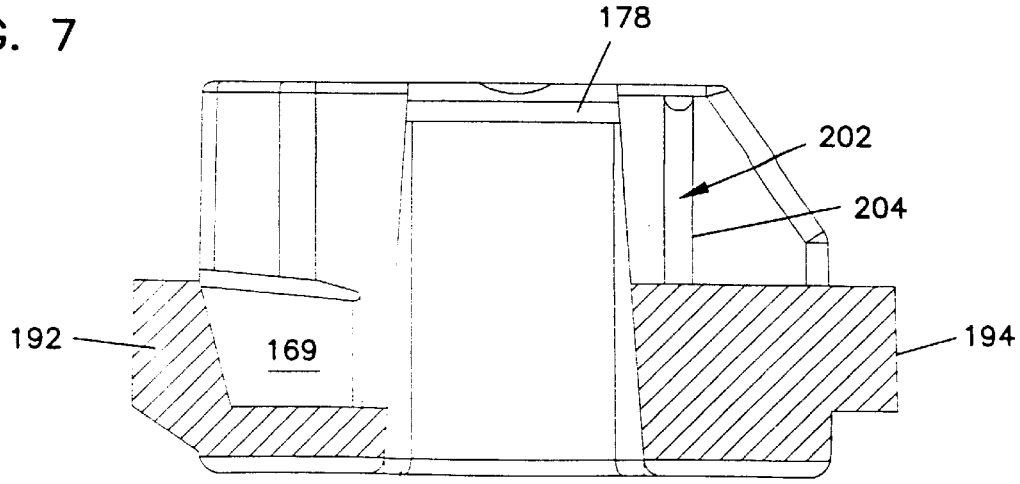
FIG. 7 is a cross-sectional view of the slider device depicted in FIG. 5 taken along the line 7—7.

Attention is again directed to FIGS. 4, 5, and 7. In the preferred embodiment, the housing 152 includes a system for reducing drag. That is, the housing 152 is designed such that the surface area contact between the housing 152 and the resealable closure mechanism 114 is minimal. In the embodiment illustrated, the system includes first and second standoffs 201, 202. The first standoff 201 preferably projects or extends from the first sidewall 172 in the form of a first pin or rod 203. Likewise, the second standoff 202 projects or extends from the second sidewall 174 in the form of a second pin or rod 204. In the preferred embodiment illustrated, the first and second rods 203, 204 project at least about 0.0085 inches (0.22 mm) from their respective sidewalls 172, 174. Preferably, the first rod 203 extends the entire length between the bottom of the first sidewall 172 and the top wall 154. Likewise, preferably the second rod 204 extends the entire length between the top wall 154 and the bottom edge of the second sidewall 174.

In operation, the standoffs 201, 202 slidably communicate with the first and second closure profiles 130, 131, respectively. Because of the projection and extension of the standoffs 201, 202 relative to the remaining portions of the housing 152, the amount of surface area contact or material inducing friction between the housing 152 and the resealable closure mechanism 114 is reduced relative to a housing construction that does not have standoffs 201, 202. This permits easier manipulation of the slider device 150 by the user.

As indicated previously, one preferred technique for manufacturing the slider housing 152 is injection molding. While other methods are possible, injection molding is convenient and preferred. In addition, injection molding allows for ornamental features to be molded as part of the housing 152. As such, the resulting housing 152 illustrated in FIGS. 3 and 4 is distinctive, eye-catching, and attractive.

To construct the flexible resealable package 110 with a slider device 150, the package 110 can be formed by either a blown extrusion process or by using a pre-formed roll of film. The film is folded in the form shown in FIG. 1. The resealable closure mechanism 114 can be applied to the film panel sections 116, 118 by heat sealing the bonding strips 132, 142 to the film sections. The notch 128 can be cut into the upper flanges 139, 147. Next, the side seals including the regions 196, 198 of ultrasonic crushing can be formed. The slider device 150 can then be mounted over the resealable closure mechanism 114 by sliding it onto the notch 128. Preferably, the notch 128 is formed twice as long as the length of the spreader 166. This is because when the slider device 150 in moved into the closed position (FIG. 8), the widest part of the spreader 166 will be situated in the open area represented by the notch 128. As a result, the spreader 166 will not spread the walls of the closure mechanism 114 at this location. This ensures that when the slider device 150 is moved all the way to the closed position, as shown in FIG. 8, the closure mechanism 114 will be completely closed and, even in the part of the closure mechanism 114 located under the separator 166, will not be spread or biased open.

The slider device 150 is pressed onto the receivable closure mechanism 114 until the first and second hook constructions 176, 178 snap over the shoulders 138, 148, respectively, of the closure profiles 130, 131, respectively.

To operate, the slider device 150 is slid relative to the resealable closure mechanism 114 from the closed position of FIG. 8 to the open position of FIG. 9. As the slider device 150 is moved from the closed position to the open position, the spreader 166 forces the closure members 134, 144 apart from each other. The spreader 166 is spaced between the upper flanges 139, 147 of the profile members 130, 131 and opens the mouth 126 as the slider device 150 is moved along the resealable package 110 in the direction toward where the triangle of spreader 166 "points." The opening happens because the triangular shape of the spreader 166 operates as a cam to force the profile members 130, 131 apart, and thus to disengage the interlocking members 134, 144. To close the resealable closure mechanism 114, the slider housing 152 is moved relative to the resealable closure mechanism 114 from the position of FIG. 9 to the position of FIG. 8. The closing happens because the slide channel 177 between the sidewalls 172, 174 is narrower at end 156 (the end away or remote from the spreader 166) and is wider at the end 155 (the end near or adjacent to the spreader 166). The spreader 166 does not depend very far downwardly into the closure mechanism 114, and it never actually passes between the interlocking members 134, 144. Thus, this helps to prevent leaks in the closure mechanism 114, when the slider device 150 is in the closed position. The slider device housing 152 may be moved until the first finger 192 abuts the side seal or region of ultrasonic crushing 196 or, in some embodiments, the edge 129*a* of the notch 128. The slider housing 152 is moved to the open position until the finger 194 abuts and engages the region 198 of ultrasonic crushing to stop the housing 152 from further sliding movement. Note that no extra tools are needed for operation.

Figure 10:
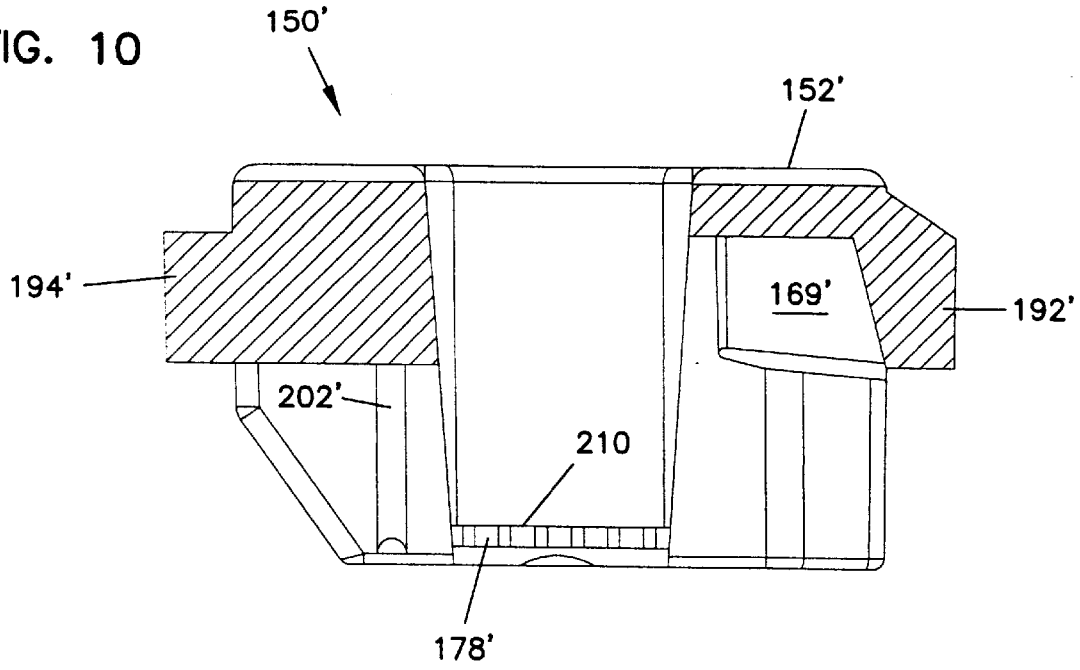
FIG. 10 is a cross-sectional view of a second embodiment of the slider device analogous to the view depicted in FIG. 7, according to principles of this disclosure.
Figure 11:
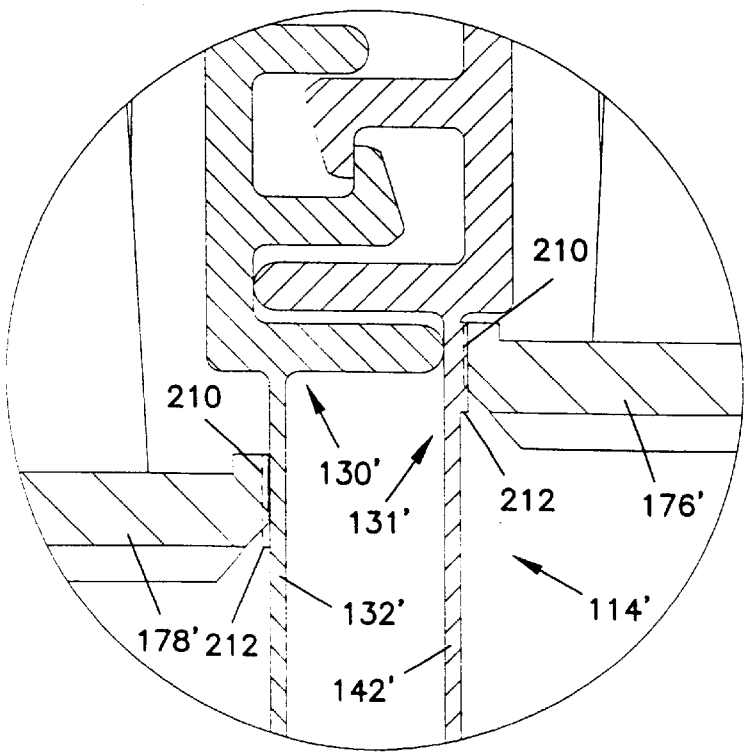
FIG. 11 is an enlarged, cross-sectional view of the slider device of FIG. 10 engaging a second embodiment of profiled elements.

FIGS. 10 and 11 are an alternate embodiment of a slider device 150' usable with a modified resealable closure mechanism 114' to result in a closure arrangement that provides tactile or audible feedback to the operator of the closure. While a variety of embodiments are contemplated herein, in the specific embodiment illustrated, the housing 152' includes ribs or ridges 210 on at least one, and preferably both, of the hook constructions 176', 178'. The ridges 210 on the first and second hook constructions 176', 178', engage or interact with or rub against corresponding ribs or ridges 212 formed on the bonding strips 132', 142' of the first and second closure profiles 130', 131', respectively. As the slider housing 152' is moved between open and closed positions, the ridges 210 engage the ridges 212 to provide a tactile indication or tactile feedback to the user.

In the embodiment shown in FIGS. 10 and 11, the ridges 210 are on the outer surface of the hook constructions 176', 178'. Other embodiments, however, are contemplated. For example, the structure described in U.S. Pat. No. 5,722,128 to Toney et al., hereby incorporated by reference, is one possible embodiment. It is contemplated that other structure for a slider device 150' may be used, analogous to that structure shown for the embodiment of FIGS. 1–9. For example, slider device 150' can include standoffs 202', a spreader with a pair of wedges including wedge 169', and a guide structure including first and second fingers 192', 194'.

Figure 12:
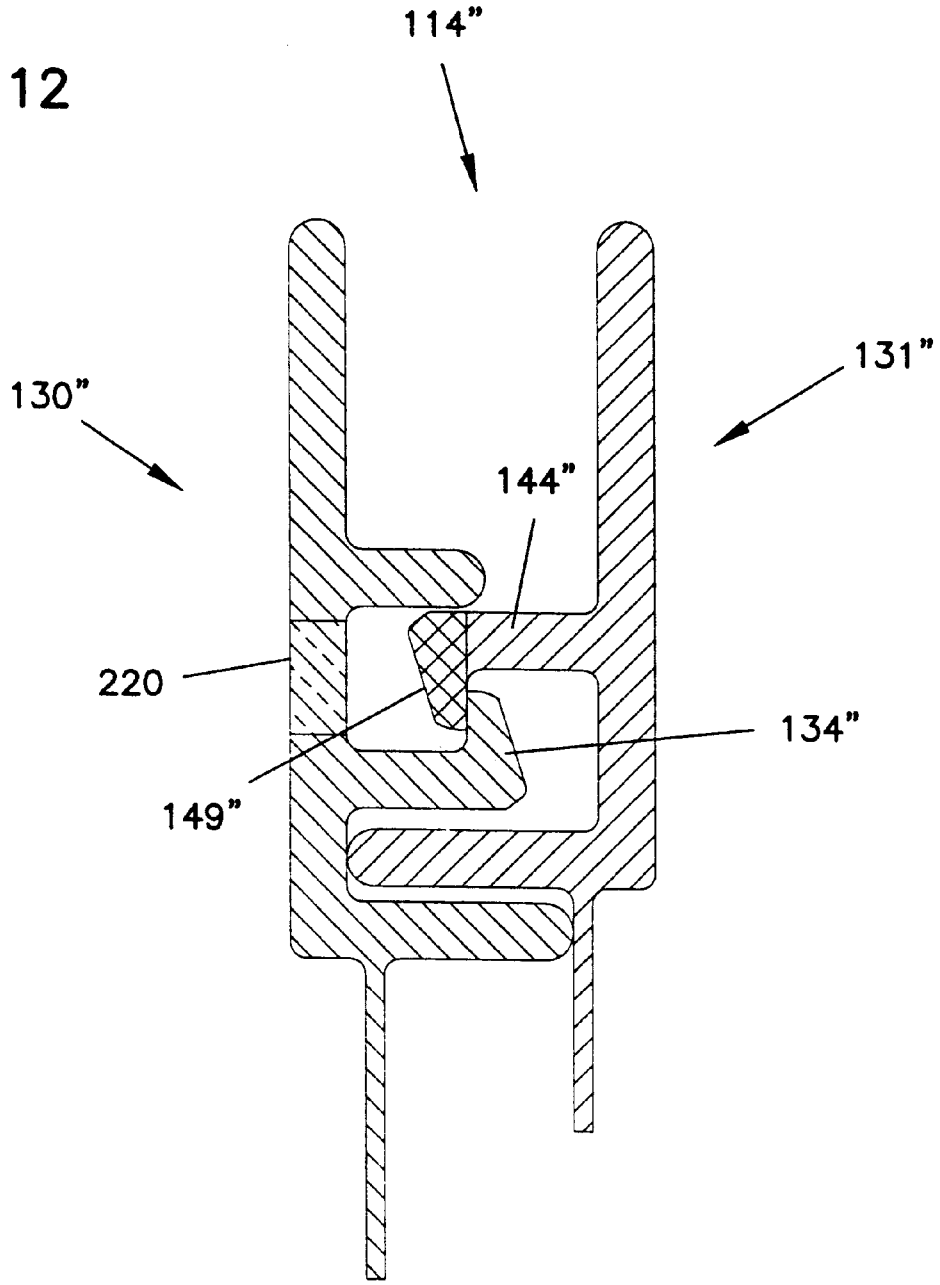
FIG. 12 is a cross-sectional view of a third embodiment of profiled elements usable with the resealable package of FIG. 1 and including color indicators, according to principles of this disclosure.

A second alternative embodiment of a resealable closure mechanism usable with slider devices described herein is shown in FIG. 12 at 114". The resealable closure mechanism 114" includes a system for providing a color change between conditions when the profiles 130" and 131" are locked and when they are unlocked. In the example illustrated, each of the profiles 130", 131" are colored a certain color, except for a transparent region 220. The catch 149" of the closure member 144" is colored a different color. In this manner, when the closure members 134" and 144" engage, the colored catch 149" is visible or viewable through the region 220 of transparent material. This provides an indication of locking. When the catch 149" is not viewable through the region 220, it is indicative that the closure members 134", 144" are not engaged. Other systems of color change may also include those as described in U.S. Pat. No. 5,248,201 to Kettner et al., hereby incorporated by reference and U.S. Pat. No. 4,829,641 to Williams, hereby incorporated by reference.

AN EXAMPLE EMBODIMENT

It will be understood that a wide variety of specific configurations and applications are feasible, using techniques described herein. In this section, a particular slider device is described.

The slider housing 152 has an overall length from the end tip of the finger 192 to the end tip of the finger 194 of at least about 0.5 inches (about 13 mm), no greater than about 2 inches (about 51 mm), typically about 0.65–0.75 inches (about 16–19 mm), and in a preferred embodiment about 0.695 inches (about 18 mm).

The finger 192 extends from the end 155 of the slider housing 152 at least about 0.03 inches (about 0.8 mm), no greater than about 0.25 inches (about 6 mm), typically about 0.055–0.065 inches (about 1.4–1.7 mm), and in a preferred embodiment about 0.06 inches (about 1.5 mm). The finger 194 extends from end 156 at least about 0.02 inches (about 0.5 mm), no greater than about 0.25 inches (about 6 mm), typically about 0.035–0.045 inches (about 0.9–1.1 mm), and in a preferred embodiment about 0.040 inches (about 1.0 mm).

Each of the fingers 192, 194 has a width of at least about 0.02 inches (about 0.5 mm), no greater than about 0.2 inches (about 5 mm), typically about 0.04–0.07 inches (about 1–1.8 mm), and in preferred embodiments about 0.05–0.06 inches (about 1.3–1.5 mm).

Each wedge 168, 169 is spaced from its respective sidewall 172, 174 by a distance of at least about 0.01 inches (about 0.3 mm), no greater than about 0.1 inches (about 3 mm), typically about 0.020–0.035 inches (about 0.5–0.9 mm), and in preferred embodiments about 0.022–0.029 inches (about 0.6–0.7 mm).

The rods 203, 204 are spaced a distance apart of at least about 0.05 inches (about 1.3 mm), no greater than about 0.25 inches (about 6.4 mm), typically about 0.1–0.12 inches (about 2.5–3.1 mm), and in preferred embodiments about 0.108 inches (about 2.7 mm).

At the second end 156, the width of the slider housing 152 as defined by the distance between the outer part of the sidewalls 172, 174 is at least about 0.1 inches (about 3 mm), no greater than about 0.5 inches (about 13 mm), typically about 0.2–0.25 inches (about 5.1–6.4 mm), and in preferred embodiments about 0.23–0.24 inches (about 5.8–6.1 mm).

The spreader 166 has a length at the base of its triangle portion of at least about 0.05 inches (about 1.3 mm), no greater than about 0.25 inches (about 6.4 mm), typically about 0.11–0.150 inches (about 2.8–3.8 mm), and in preferred embodiments about 0.12–0.14 inches (about 3.0–3.6 mm).

The length of the sidewall 174 is at least about 0.25 inches (about 6.4 mm), no greater than about 1 inch (about 25 mm), typically about 0.34–0.4 inches (about 8.6–10.2 mm), and in preferred embodiments about 0.35–0.395 inches (about 8.9–10.0 mm). The length of the sidewall 172 is at least about 50 percent of the length of the sidewall 174, no greater than about 100 percent, and typically about 85–95 percent. This would be typically about 0.30–0.38 inches (about 7.6–9.7 mm), and in preferred embodiments about 0.31–0.36 inches (about 7.9–9.1 mm).

The overall distance between the tip 182 and the tip 186 is at least about 0.02 inches (about 0.5 mm), no greater than about 0.1 inches (about 2.5 mm), typically about 0.04–0.05 inches (about 1–1.3 mm), and in preferred embodiments about 0.045 inches (about 1.2 mm).

The depth of the spreader 166 from the top wall 154 is at least about 0.05 inches (about 1.3 mm), no greater than about 0.5 inches (about 13 mm), typically about 0.11–0.2 inches (about 2.8–5.1 mm), and in preferred embodiments about 0.11–0.13 inches (about 2.8–3.3 mm).

AN ADDITIONAL EMBODIMENT

Figure 16:
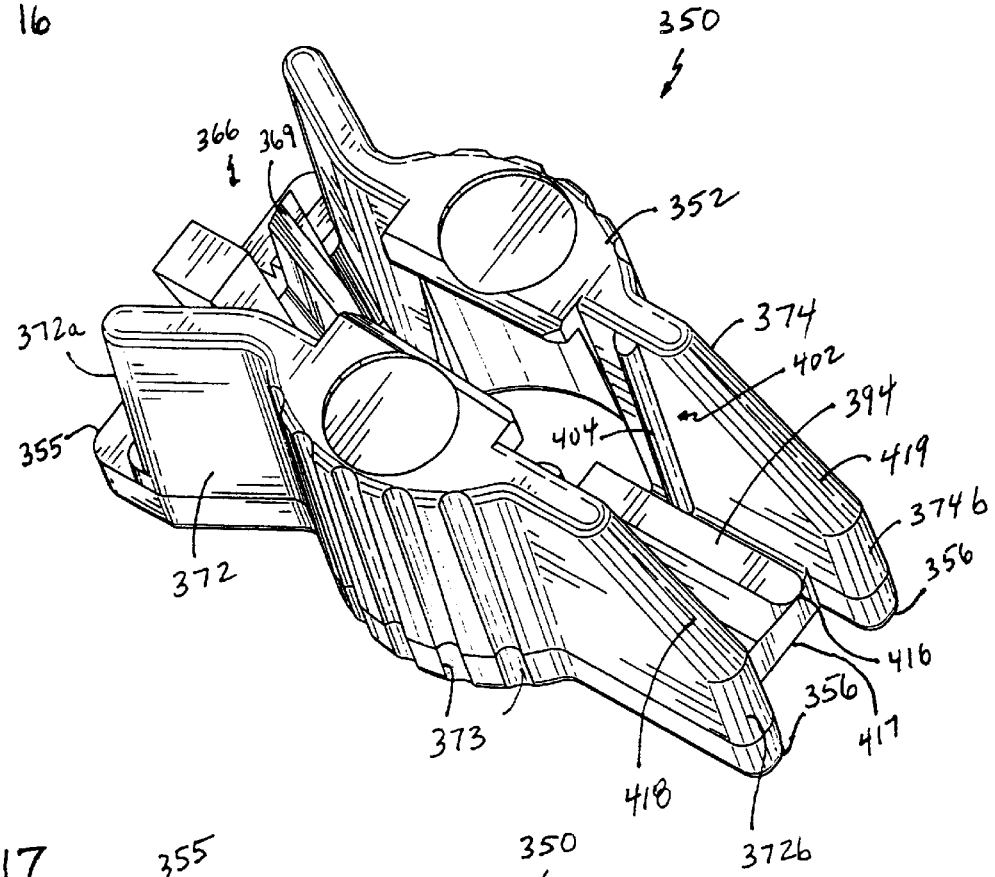
FIG. 16 is an enlarged, bottom perspective view of another embodiment of a slider device, constructed according to principles of this disclosure.
Figure 17:
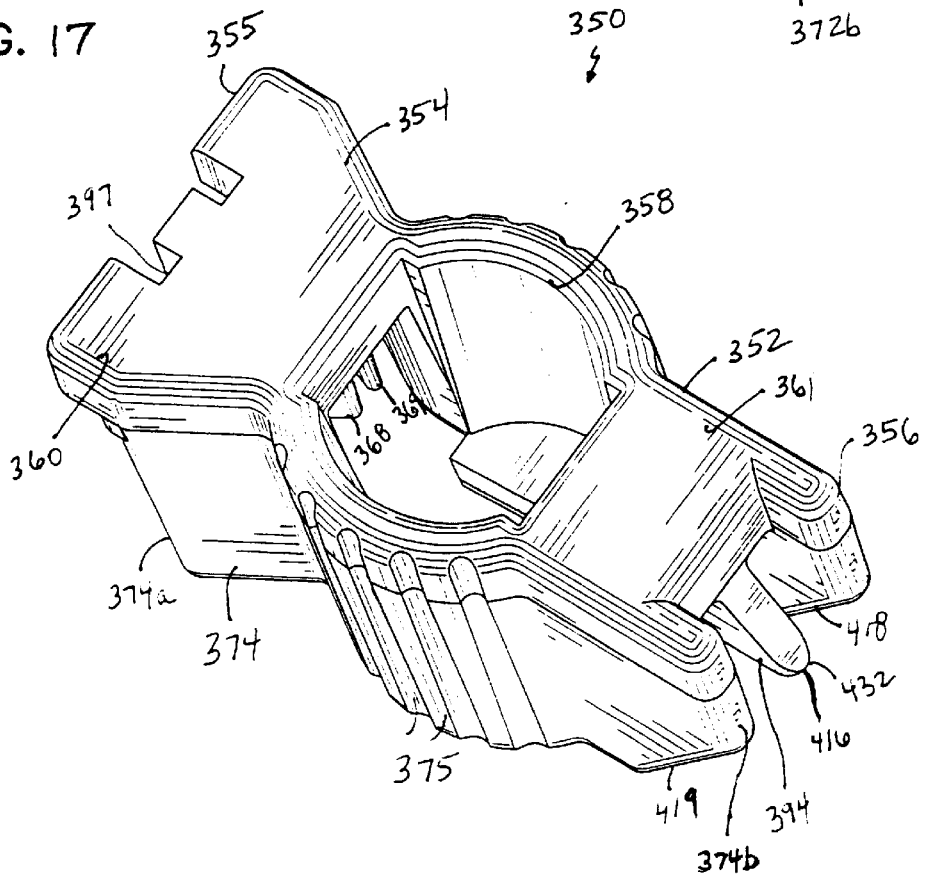
FIG. 17 is an enlarged, top perspective view of the slider device of FIG. 16.

Attention is directed to FIGS. 16–23 that show an additional embodiment of a slider device constructed according to principles of this disclosure. FIGS. 16 and 17 show a slider device 350 in perspective views. The slider device 350 is generally constructed analogously to the embodiment of FIGS. 3–9, but with some modifications, to be discussed below. As with the embodiment of FIGS. 3–9, the slider device 350 has a housing 352, which includes a top wall 354 having a first end 355 and a second end 356. The top wall 354 has an open aperture 358, which divides the top wall 354 into a first portion 360 and a second portion 361. Note that the first portion 360 and second portion 361 of the top wall 354 are smooth and planar. Note the absence of grooves in top wall 354.

Figure 18:
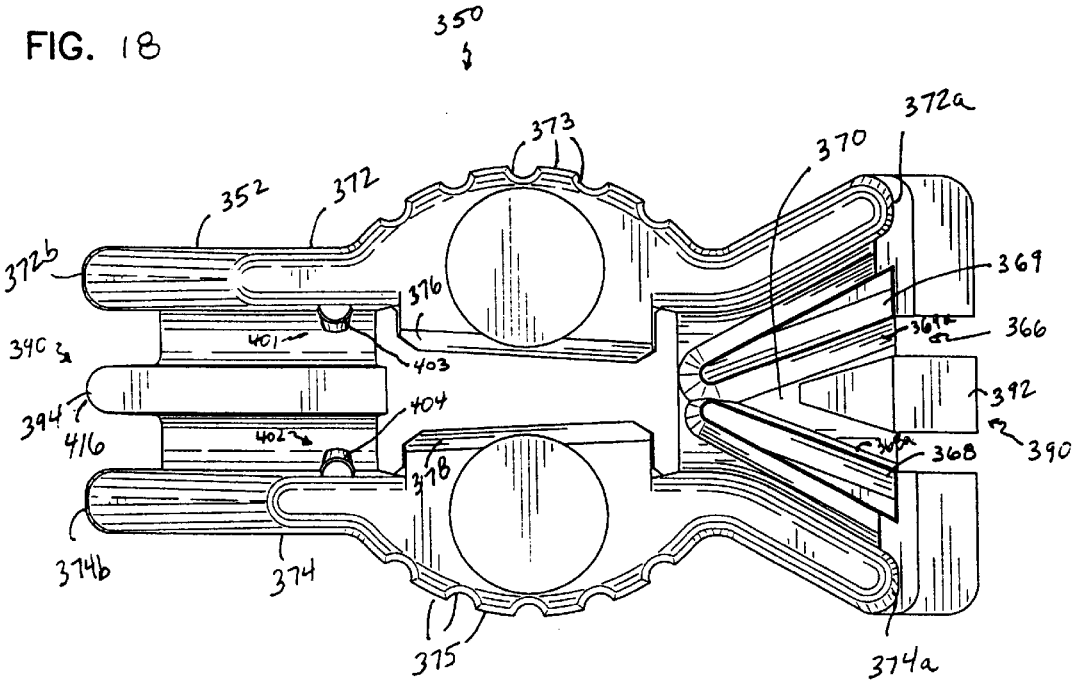
FIG. 18 is a bottom plan view of the slider device depicted in FIG. 17.

As with the embodiment with FIGS. 3–9, the slider device 350 includes a plow 366. Attention is directed to FIG. 18. The plow 366 includes a first wedge 368 and a second wedge 369. Between the first wedge 368 and the second wedge 369 is a gap 370.

The housing 352 also includes a first sidewall 372 with a texturized surface to enhance gripping, for example ribs 373. The housing 352 also has a second sidewall 374 with ribs 375. The first sidewall 372 has a first end 372*a* that is adjacent to the plow 366 and an opposite, second end 372*b*. Similarly, the second sidewall 374 has a first end 374*a* adjacent to the plow 366 and a second, opposite end 374*b*.

As with the embodiment of FIGS. 3–9, the slider 350 includes the first hook construction 376 and a second hook construction 378. In reference now to FIG. 21, the first hook construction 376 includes a flange 380 in extension from the first sidewall 372. Note that in this embodiment, there are no tips or projections extending from the flange 380. Similar to the first hook construction 376, the second hook construction 378 has a flange 384 extending from the second sidewall 374. There is no tip or any other extension projecting from the flange 384.

Figure 22:
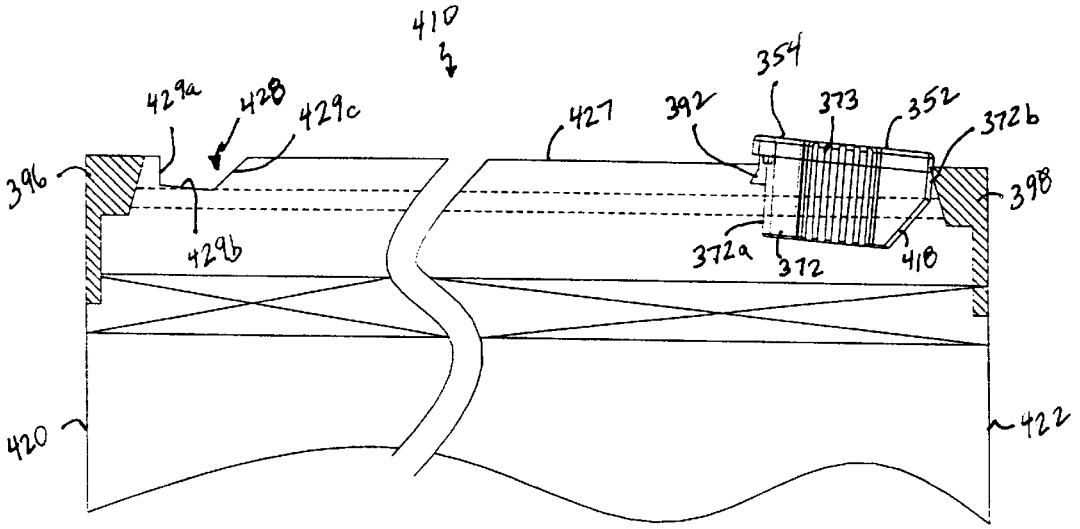
FIG. 22 is an enlarged, side elevational, fragmented, schematic view of the slider device of FIGS. 16–21 and shown in an open position of a resealable package.
Figure 23:
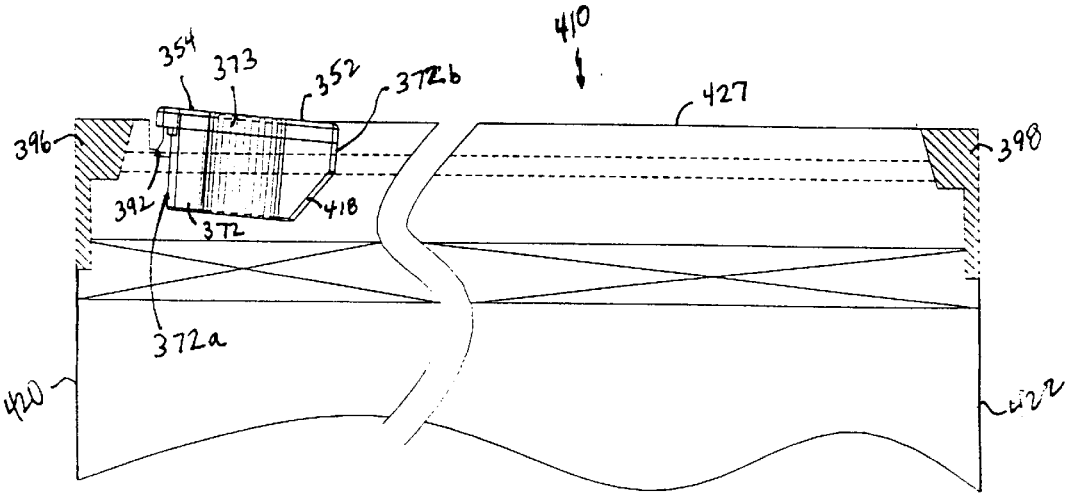
FIG. 23 is an enlarged, side elevational, fragmented, schematic view of the slider device depicted in FIGS. 16–21 oriented in a closed position of a resealable package.

Again, analogous to the embodiment of FIGS. 3–9, the slider device 350 includes a system for guiding the slider device 350 between the side edges 420, 422 (FIG. 23) and for preventing the slider device 350 from sliding off of the edge of the package 410 (FIG. 23). In the embodiment illustrated, the system includes a guide construction 390 (FIG. 18). The guide construction 390 of this embodiment differs somewhat from the embodiment of FIGS. 3–9. The guide construction 390 shown is constructed and arranged to detect regions of ultrasonic crushing 396, 398 (FIGS. 22 and 23) before any other structure on the housing 352 engages sides 420, 422 (FIGS. 22 and 23) of package 410. In this embodiment, the guide construction 390 depends or extends from the top wall 354, but could depend from other portions of the housing 352 in other embodiments.

Figure 19:
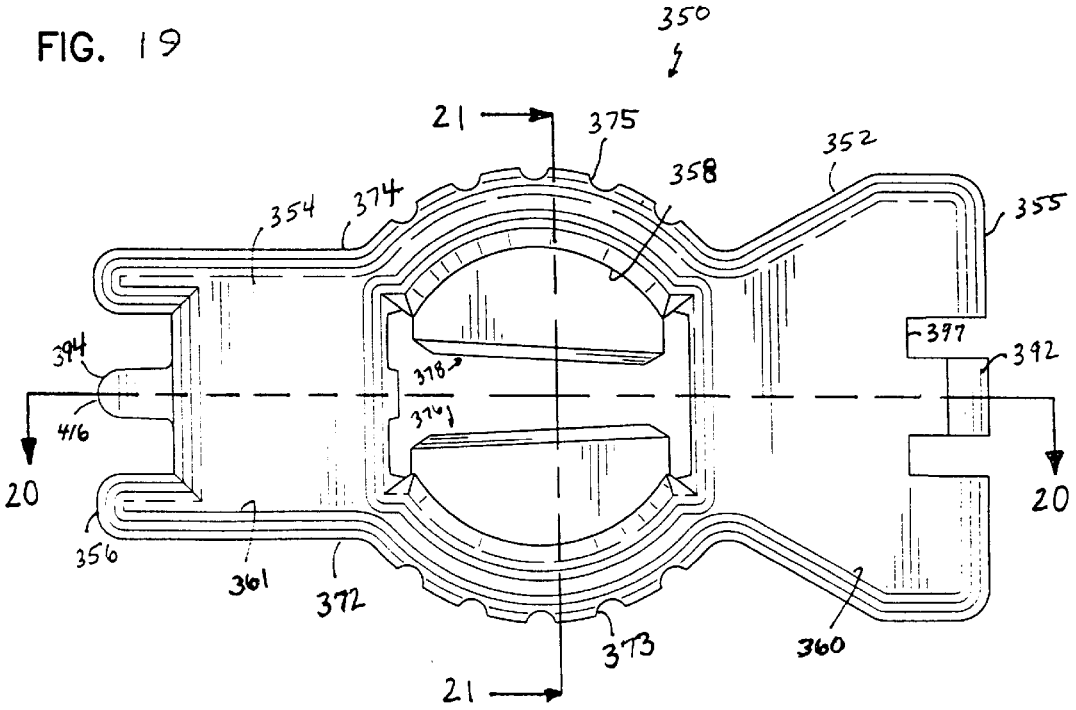
FIG. 19 is a top plan view of the slider device depicted in FIG. 17.

The guide construction 390 comprises first and second bumpers or elongate fingers 392, 394 (FIGS. 18 and 19). The first finger 392 preferably is molded as part of the housing 352. In this embodiment, the first finger 392 extends or projects a distance beyond a recesses portion 397 (FIG. 19) of the top wall 354, but is otherwise even with the first end 355 of the top wall 354. This construction is preferred because, among other reasons, during the assembly process, the slider housings 352 do not jam or stack on top of each other. As can be seen in FIG. 18, the first finger 392 extends or projects a distance beyond the first end 372*a* of the first sidewall 372. Likewise, the first finger 392 extends or projects beyond the first end 374*a* of the second sidewall 374.

The first finger 392 is constructed and arranged to extend or dig into the region of ultrasonic crushing 396, if the slider housing 352 is moved past a notch 428 (FIG. 22). Note that the notch 428 of FIG. 22 is constructed analogously to the notch 128 of FIG. 1, including notch side edges 429*a*, 429*b*, and angles side edge 429*c*. Side edge 429*c* is angled at least about 10°, typically about 20–70°, and preferably about 45° from a line parallel to a top edge 427 of package 410. Alternatively stated, the angled side edge 429*c* extends at an angle of at least about 10°, typically about 20–70°, and preferably about 45° from a line parallel to the side edge 420.

Normally, the inside edges 368*a* and 369*a* (FIG. 18) of the first and second wedges 368, 369 will engage the side edges 429*c* of the notch 428. This will act as a stop member and provide a tactile indication that the housing 352 is "parked" or in a closed position. If, however, the slider housing 352 is forcibly moved toward the side edge 420, then the first finger 392 will engage or bump into the region of ultrasonic crushing 396. The shape of the first finger 392 allows the first finger 392 to engage the region of ultrasonic crushing 396 without having other portions of the slider housing 352 from engaging the region of ultrasonic crushing 396. This also stops the slider housing 352 from being pushed off the end of the package 410.

Figure 20:
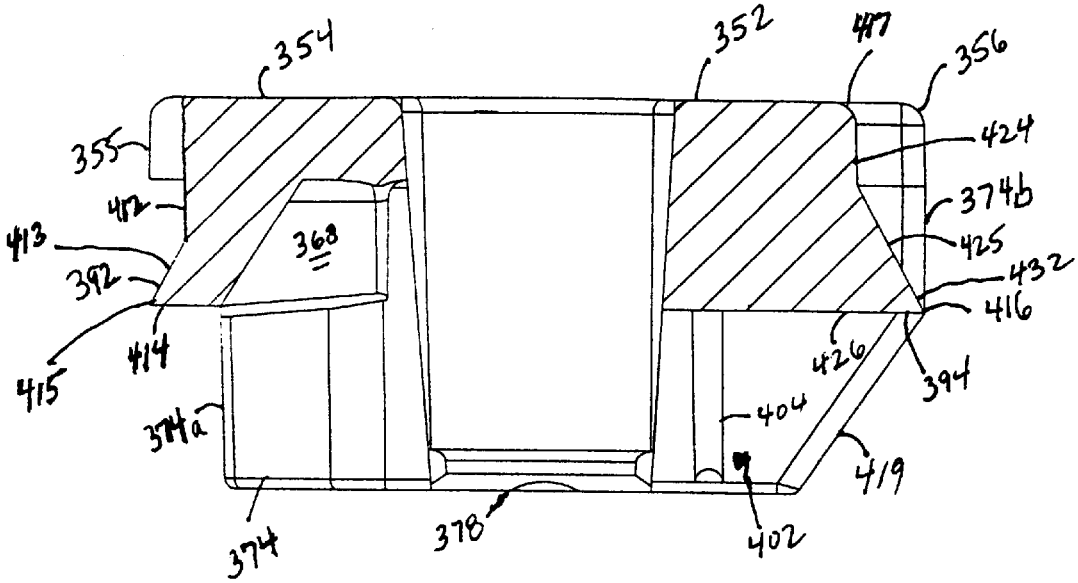
FIG. 20 is a cross-sectional view of the slider device depicted in FIG. 19, taken along the line 20—20 of FIG. 19.
Figure 21:
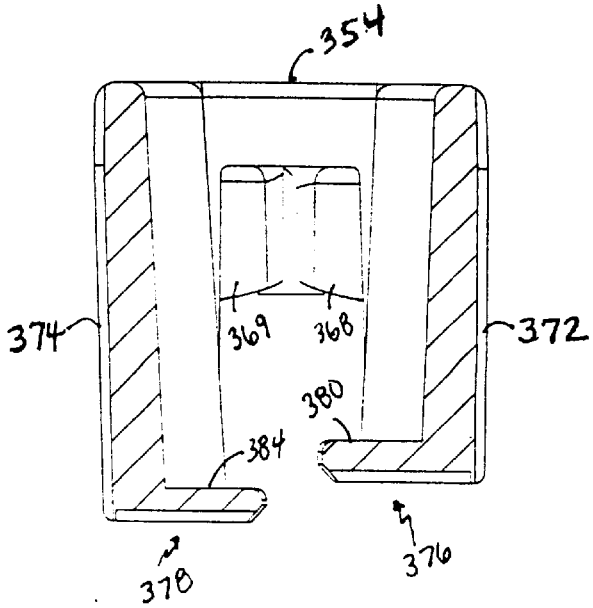
FIG. 21 is a cross-sectional view of the slider device depicted in FIG. 19, taken along the line 21—21 of FIG. 19.

In particular, and in reference now to FIG. 20, the first finger 392, in cross section has a first portion 412 that extends from the top wall 354, and preferably, is normal to the top wall 354. As can be seen in FIG. 20, the preferred embodiment has the first portion 412 being straight and generally parallel to the first end 374*a* of the second sidewall 374. Extending from the first portion 412 is an angled edge 413. In preferred embodiments, the angle between the first portion 412 and the angled edge 413 is at least about 90°, typically about 120–170°, and in preferred embodiments about 150°. Immediately adjacent to the angled edge 413 and intersecting the angled edge 413 is an edge 414. Edge 414, in preferred constructions, is generally parallel to the top wall 354. As such, the angled edge 413 and edge 414 cooperate to form a nose 415 of the first finger 392. The nose 415 is the structure that will, in preferred embodiments, engage the region of ultrasonic crushing 396, if the slider housing 352 is forced all of the way it can be toward the side edge 420 and into the region of ultrasonic crushing 396. The angle between edge 413 and edge 414 to form nose 415 is at least about 15°, typically about 30–80°, and in preferred embodiments about 60°.

Still referring to FIG. 20, the second finger 394 is illustrated in cross section. Note that the second finger 394, in preferred arrangements, at its outermost portion or nose 416 extends about even with the second ends 372*b* and 374*b* (FIG. 18). The nose 416 also extends about even with the second 356 of the top wall 354. The second finger 394 does extend or project beyond the recessed region 417 of the top wall 354. This construction is preferred because, among other reasons, during the assembly process, the slider housings 352 do not jam or stack on top of each other. While a variety embodiments for the second finger 394 are contemplated, in the particular embodiment shown in FIG. 20, the second finger 394 has a first portion 424 extending perpendicularly or normal to the top wall 354. An angled edge 425 is adjacent to and angled from the first portion 424. In typical embodiments, the angle between the first portion 424 and angled edge 425 will be between at least about 90°, typically about 120–170°, and preferably about 150°. Immediately adjacent to and intersecting the angled edge 425 is edge 426. The edge 426 preferably is generally parallel to the top wall 354. The edge 426 and the angled edge 425 intersect to form the nose 416. The angle between edge 425 and edge 426 is at least about 15°, typically about 30–80°, and in preferred embodiments about 60°.

Note that the first and second sidewalls 372, 374 include sloped or beveled edges 418, 419, respectively. As can be seen in FIG. 20, the nose 416 extends or projects beyond the beveled edge 419. Analogously, the nose 416 also extends beyond the beveled edge 418, although not illustrated in FIG. 20.

The nose 416 acts to engage or bump into the second region of ultrasonic crushing 398. This engagement between the nose 416 and the second region of ultrasonic crushing 398 prevents someone from forcibly sliding the slider housing 352 off of the end of the package 410.

Referring again to FIGS. 16, 18, and 20, the slider housing 352 includes first and second standoffs 401, 402. Standoffs 401, 402 are constructed and function analogously to standoffs 201, 202 described previously. The first standoff 401, in the illustrated embodiment, includes a rod 403 extending or projecting from the first sidewall 372. Similarly, the second standoff 402 includes a rod 404 extending or projecting from the second sidewall 374.

The slider device 350 is operated in a similar manner as described above for slider device 352.

The above specification and examples are believed to provide a complete description of the manufacture and use of particular embodiments of the invention. Many embodiments of the invention can be made without departing from the spirit and scope of the invention.

We claim:

1. A flexible package comprising:

(a) a package surrounding wall having first and second side seals and a mouth therebetween; said mouth providing access to a package interior;

(b) a recloseable zipper along said mouth for selective opening and closing of said mouth; said zipper including first and second closure profiles;

(i) said first closure profile defining a first shoulder;

(A) said first profile including: a first closure member with a first catch; a first guidepost; a second guidepost; a first upper flange; and a first sealing flange;

(1) said first shoulder being between said second guidepost and said first sealing flange;

(2) said first sealing flange being secured to said package surrounding wall;

(ii) said second closure profile defining a second shoulder;

(A) said second profile including: a second closure member with a second catch; a third guidepost; a second upper flange; and a second sealing flange;

(1) said first and second catches being constructed and arranged for selective interlocking;

(2) said second shoulder being between said third guidepost and said second sealing flange;

(3) said second sealing flange being secured to said package surrounding wall;

(iii) said first and second closure profiles being constructed and arranged to interlock; and (c) a slider device for selectively opening and closing said zipper; said slider device including:

(i) a top wall;

(A) said top wall being mounted for slidable movement over said first and second upper flanges;

(ii) a spreader depending from said top wall for separating said first and second closure profiles;

(iii) a first hook construction having a first flange to slidably cover said first shoulder of said first closure profile;

(iv) a second hook construction to slidably cover said second shoulder of said second closure profile;

(v) a first sidewall depending from said top wall; said first sidewall having first and second opposite ends; and (vi) a guide construction extending past at least one of said first and second ends of said first sidewall in a direction away from remaining portions of said slider device and toward one of said first and second side seals;

(A) said guide construction being constructed and arranged to engage at least one of said first and second side seals, when the slider device is selectively moved along the mouth adjacent to one of the first and second seals.

2. A flexible package according to claim 1 wherein:

(a) each of said first and second upper flanges defines a notch adjacent to said first side seal;

(i) each of said notches having a length greater than a length of said spreader.

3. A flexible package according to claim 2 wherein:

(a) said guide construction includes at least a first finger depending from said top wall; and (i) said first finger projecting beyond said first end.

4. A flexible package according to claim 1 wherein:

(a) said slider device further includes:

(i) a second sidewall depending from said top wall; a first standoff in extension from said first sidewall; and a second standoff in extension from said second sidewall;

(A) said first standoff being in slidable communication with said first profile; and (B) said second standoff being in slidable communication with said second profile.

5. A recloseable zipper arrangement comprising:

(a) a first closure profile; said first closure profile defining a first shoulder;

(i) said first profile includes: a first closure member with a first catch; a first guidepost; a second guidepost; a first upper flange; and a first sealing flange;

(ii) said first shoulder being between said second guidepost and said first sealing flange;

(b) a second closure profile; said second closure profile defining a second shoulder;

(i) said first and second closure profiles being constructed and arranged to interlock;

(ii) said second profile includes: a second closure member with a second catch; a third guidepost; a second upper flange; and a second sealing flange;

(A) said first and second catches being constructed and arranged for selective interlocking;

(B) said second shoulder being between said third guidepost and said second sealing flange; and (c) a slider device operably mounted on said first and second closure profiles; said slider device including:

(i) a top wall;

(A) said top wall being mounted for slidable movement over said first and second upper flanges;

(ii) a spreader depending from said top wall to separate said first and second closure profiles;

(iii) a first hook construction to slidably cover said first shoulder of said first closure profile;

(iv) a second hook construction to slidably cover said second shoulder of said second closure profile;

(v) a first sidewall depending from said top wall; said first sidewall having first and second opposite ends;

(vi) a guide construction projecting beyond at least one of said first end and said second end of said first sidewall in a direction away from remaining portions of said slider device;

(vii) a second sidewall depending from said top wall; a first standoff in extension from said first sidewall; a second standoff in extension from said second sidewall;

(A) said first standoff being in slidable communication with said first profile; and (B) said second standoff being in slidable communication with said second profile.

6. A recloseable zipper arrangement according to claim 5 wherein:

(a) said first hook construction comprises a first flange in lateral extension from said first sidewall;

(i) said first flange slidably covering said first shoulder; and (b) said second hook construction comprises a second flange in lateral extension from said second sidewall;

(i) said second flange slidably covering said second shoulder.

7. A recloseable zipper arrangement according to claim 6 wherein:

(a) said first hook construction and said first shoulder include engaging ridges to provide tactile feedback.

8. A recloseable zipper arrangement according to claim 7 wherein:

(a) said second hook construction and said second shoulder include engaging ridges to provide tactile feedback.

9. A recloseable zipper arrangement according to claim 6 wherein:

(a) said first and second profiles are constructed and arranged to provide a color change between when said first and second profiles are interlocked and when said first and second profiles are not interlocked.

10. A recloseable zipper arrangement according to claim 5 wherein:

(a) said guide construction includes first and second fingers depending from said top wall.

11. A recloseable zipper arrangement according to claim 10 wherein:

(a) said spreader comprises first and second angled wedges defining a gap therebetween; said first and second angled wedges depending from said top wall.

12. A slider device for use with a resealable package having interlocking closure members, the slider device comprising:

(a) a top wall;

(b) a spreader depending from and being integral with said top wall; said spreader for camming apart interlocked closure members, when the slider device is operably mounted on a resealable package with interlocking closure members;

(c) a first sidewall; said first sidewall including at least a portion cantilevered from and integral with said top wall; said first sidewall having first and second opposite ends;

(d) a second sidewall; said second sidewall including at least a portion cantilevered from and integral with said top wall;

(i) said first and second sidewalls defining a slide channel for receipt of interlocking closure members, when the slider device is operably mounted on the resealable package with interlocking closure members;

(e) a first hook construction extending from and integral with said first sidewall;

(f) a second hook construction extending from and integral with said second sidewall;

(i) said first and second hook constructions for locking the slider device onto the resealable package, when the slider device is operably mounted on the resealable package with interlocking closure members; and (g) a guide construction extending past at least one of said first end and said second end of said first sidewall in a direction from remaining portions of the slider device;

(i) said guide construction depending from said top wall;

(ii) said guide construction including first and second fingers; said first finger projecting beyond said first end; said second finger depending from said top wall.

13. A slider device according to claim 12 wherein:

(a) said guide construction extends past said first end and not past said second end.

14. A slider device according to claim 12 further including:

(a) a first standoff in projection from said first sidewall; and (b) a second standoff in projection from said second sidewall.

15. A slider device according to claim 14 wherein:

(a) said first standoff extends a distance of at least about 0.0085 inches from said first sidewall; and (b) said second standoff extends a distance of at least about 0.0085 inches from said second sidewall.

16. A slider device according to claim 15 wherein:

(a) said first standoff extends along said first sidewall between said top wall and a bottom edge of said first sidewall; and (b) said second standoff extends along said second sidewall between said top wall and a bottom edge of said second sidewall.

17. A slider device according to claim 16 wherein:

(a) said top wall defines an open aperture;

(i) a first portion of said top wall extending between said first end and said open aperture; said first finger depending from said first portion; and (ii) a second portion of said top wall extending between said second end and said open aperture; said second finger depending from said second portion.

18. A slider device according to claim 17 wherein:

(a) said first hook construction is oriented along a portion of said first sidewall under said open aperture in said top wall; and (b) said second hook construction is oriented along a portion of said second sidewall under said open aperture in said top wall.

19. A slider device according to claim 18 wherein:

(a) said spreader comprises first and second angled wedges defining a gap therebetween; said first and second angled wedges depending from said first portion of said top wall.

20. A slider device according to claim 19 wherein:

(a) said first finger extends at least 0.06 inches past said first end.

21. A slider device according to claim 20 wherein:

(a) said first hook construction comprises a first flange in lateral extension from said first sidewall; and (b) said second hook construction comprises a second flange in lateral extension from said second sidewall.

22. A slider device according to claim 21 wherein:

(a) at least one of said first and second hook constructions defines a plurality of ridges to provide tactile feedback.

23. A flexible package comprising:

(a) a package surrounding wall having first and second side seals and a mouth therebetween; said mouth providing access to a package interior;

(b) a recloseable zipper along said mouth for selective opening and closing of said mouth; said zipper including first and second closure profiles;

(i) said first closure profile defining a first shoulder; a first closure member; and a first upper flange;

(ii) said second closure profile defining a second shoulder; a second closure member; and a second upper flange;

(iii) said first and second closure members being constructed and arranged to interlock; and (c) a slider device for selectively opening and closing said zipper; said slider device including:

(i) a top wall;

(ii) a spreader depending from said top wall; said spreader separating said first and second closure profiles;

(A) said spreader extending only between said first and second upper flanges and not penetrating between said first and second closure members;

(iii) a first hook construction having a first flange to slidably cover said first shoulder of said first closure profile;

(iv) a second hook construction to slidably cover said second shoulder of said second closure profile;

(v) a first sidewall depending from said top wall; said first sidewall having first and second opposite ends; and (vi) a guide construction extending past at least one of said first and second ends of said first sidewall in a direction away from remaining portions of said slider device and toward one of said first and second side seals;

(A) said guide construction being constructed and arranged to engage at least one of said first and second side seals, when the slider device is selectively moved along the mouth adjacent to one of the first and second side seals, and to maintain said spreader in a position spaced from each of said first and second side seals.

24. A flexible package according to claim 23 wherein:

(a) each of said first and second upper flanges defines a notch adjacent to said first side seal;

(i) each of said notches having a length greater than a length of said spreader.

25. A flexible package according to claim 23 wherein:

(a) said guide construction includes at least a first finger depending from said top wall;

(i) said first finger projecting beyond said first end.

26. A flexible package according to claim 23 wherein:

(a) said slider device further includes:

(i) a second sidewall depending from said top wall; a first standoff in extension from said first sidewall; and a second standoff in extension from said second sidewall;

(A) said first standoff being in slidable communication with said first profile; and (B) said second standoff being in slidable communication with said second profile.

27. A method of using a resealable package comprising steps of:

(a) providing a package having first and second opposite side seals; a resealable mouth between the first and second side seals; and a first resealable zipper arrangement with a slider device thereover for opening and resealing the mouth; the slider device including a spreader for separating the zipper arrangement and a first projecting finger extending away from an end of the slider device;

(i) the first resealable zipper arrangement including at least first and second selectively interlocking closure members and first and second upper flanges;

(b) moving the slider device along the mouth a first direction from the second side seal until the projecting finger engages the first side seal, the spreader remaining spaced from the first side seal;

(i) the step of moving the slider device including moving the spreader between the first and second upper flanges while not penetrating between the first and second interlocking closure members.

28. A method according to 27 wherein the step of providing a package having a slider device includes the slider device further including a second projecting finger; and further including a step of:

(a) moving the slider device along the mouth a second direction from the first side seal until the second projecting finger engages the second side seal.

29. A method according to claim 27 wherein:

(a) said step of providing includes providing a package wherein the first and second side seals comprise regions of ultrasonic crushing.

* * * * *